US005205803A

United States Patent [19]

Zemitis

[11] Patent Number: 5,205,803

[45] Date of Patent: Apr. 27, 1993

[54] ELASTIC CORD APPARATUS

[76] Inventor: Martin S. Zemitis, P.O. Box 974, Davis, Calif. 95617

[21] Appl. No.: 864,303

[22] Filed: Apr. 6, 1992

[51] Int. Cl.[5] ..... A63B 21/02; A63B 21/04

[52] U.S. Cl. ..... 482/121; 482/122; 482/124; 482/126; 482/130

[58] Field of Search ..... 482/121, 122, 123, 124, 482/125, 126, 129, 130, 148

[56] References Cited

U.S. PATENT DOCUMENTS

| | | | |
|---|---|---|---|
| 655,671 | 8/1900 | Crooker | 482/121 |
| 2,035,010 | 3/1936 | Rawlings | 482/124 |
| 3,445,109 | 5/1969 | Kolbel | 482/125 |
| 4,193,593 | 3/1980 | Wilson | 482/122 |
| 4,591,150 | 5/1986 | Mosher | 482/125 |
| 5,112,287 | 5/1992 | Brewer | 482/123 |

*Primary Examiner*—Richard J. Apley
*Assistant Examiner*—Lynne A. Reichard
*Attorney, Agent, or Firm*—Thomas R. Lampe

[57] ABSTRACT

Attachment elements are connected to spaced ends of an elastic cord. A shroud extends the length of the cord between the attachment elements and is affixed to the attachment elements. The shroud is a tubular-shaped member forming a plurality of pleats when the elastic cord is in unelongated condition. When the elastic cord is elongated and the shroud is unpleated it provides a positive restraint against further stretching of the elastic cord.

7 Claims, 4 Drawing Sheets

ELASTIC CORD APPARATUS

TECHNICAL FIELD

This invention relates to elastic cord apparatus. More particularly, the invention has application to elastic cords of the type utilized, for example, in the sport of bungee jumping.

BACKGROUND ART

The sport of bungee jumping is becoming increasingly popular. When practicing the sport, an individual wears a harness attached to an end of an elastic cord, the other end of the elastic cord being attached to an elevated structure. The bungee jumper, while the elastic cord is slack, jumps from an elevated position. The length of the elastic cord, or bungee cord as it is commonly known, is such that it stretches at the end of the fall to arrest the downward movement of the jumper. The inherent resiliency of the elastic cord then causes upward rebound of the jumper.

It is known to incorporate braiding along the length of an elastic cord to surround and protect the inner elastic cord (which may be single strand or multi-strand) and to function as a safety back-up in the event of elastic strand breakage. Such braiding, to some degree at least, functions as a support for a suspended bungee jumper in the event of elastic strand breakage or failure. The braiding also operates to limit the degree of stretching of the elastic cord; however, the braiding does not act as a positive restraint, instead permitting stretch of the cord with which it has been combined over a considerable, and relatively unpredictable, range. Thus, there is no absolute assurance that a jumper's downward motion will be terminated in a predictable manner by the braiding.

Another difficulty inherent in the use of braiding in operative association with an elastic cord employed as a bungee or shock cord, is the fact that the inner elastic strand or strands are always under tension. That is, braiding stresses the elastic strands with which it is associated at all times even when the strands are not stretched. Of course, when stretching does occur due to normal use of the shock cord, such stress becomes even greater. This can shorten the operating life of the cord adversely affect its performance.

DISCLOSURE OF INVENTION

The present invention relates to an elastic cord construction or apparatus wherein the elastic cord of such apparatus is combined with other structural components which protect and cover the elastic strands and cooperate therewith to positively restrict stretching of the elastic cord to a predetermined limit. Furthermore, this objective is attained even in the event of a break occurring in the elastic portion of the cord. A jumper utilizing the apparatus is assured at all times that his or her fall will not exceed a predetermined distance. The apparatus also affords protection for the elastic strands from abrasion, ultraviolet rays and the like, while imposing no undue stresses on the elastic cord. The apparatus is characterized by its relatively low cost as well as by its high degree of reliability.

The apparatus of the present invention includes an elastic cord having spaced ends. Attachment elements are located at each of the elastic cord ends for attaching the elastic cord ends to relatively movable objects, movement of said objects away from each other causing stretching of the elastic cord.

Shroud means covers the elastic cord and extends between the attachment elements. The shroud means is affixed to the attachment elements.

The shroud means comprises a generally tubular-shaped member extending along the full length of the elastic cord and forming a plurality of pleats when the elastic cord is in unelongated condition.

The generally tubular-shaped member is formed of woven fabric material which becomes unpleated when the objects are moved away from each other a predetermined distance. The generally tubular-shaped member is operable upon unpleating thereof to positively prevent the objects from moving further apart than the predetermined distance. At least one of the attachment members comprises a strap forming a loop projecting from an end of the elastic cord. The shroud means partially covers the strap and is affixed thereto by securing means. In the invention as disclosed herein the securing means comprises stitching passing through the strap and the shroud means.

The elastic cord is doubled back on itself to form engaging cord segments defining a bight at at least one of the elastic cord ends. Fastener means is disposed about the engaging cord segments for maintaining the bight.

Other features, advantages, and objects of the present invention will become apparent with reference to the following description and accompanying drawings.

MODES FOR CARRYING OUT THE INVENTION

Figure 1:
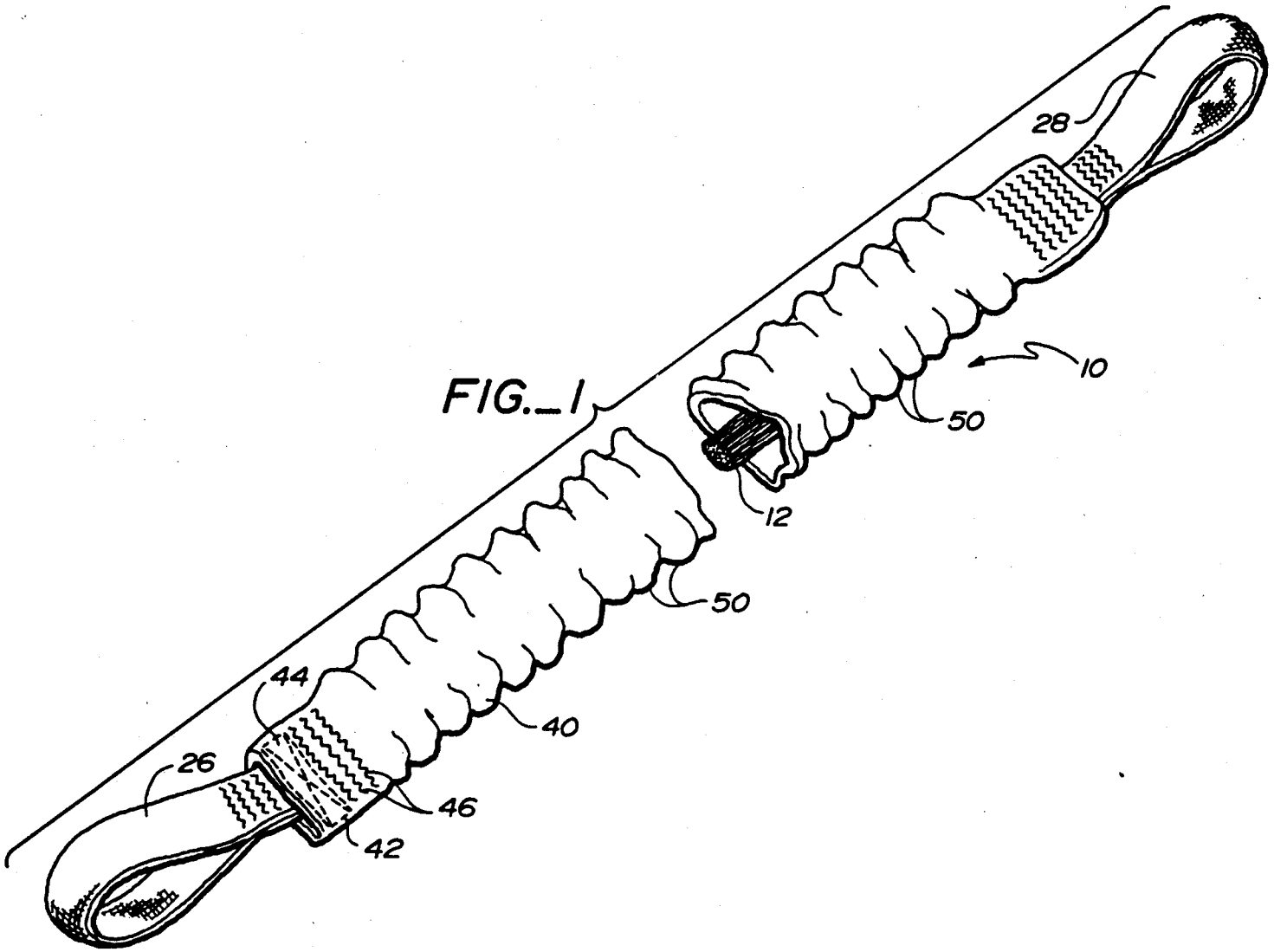
FIG. 1 is a perspective view of a preferred form of apparatus constructed in accordance with the teachings of the present invention, a portion thereof broken away to better illustrate details thereof.
Figure 2:
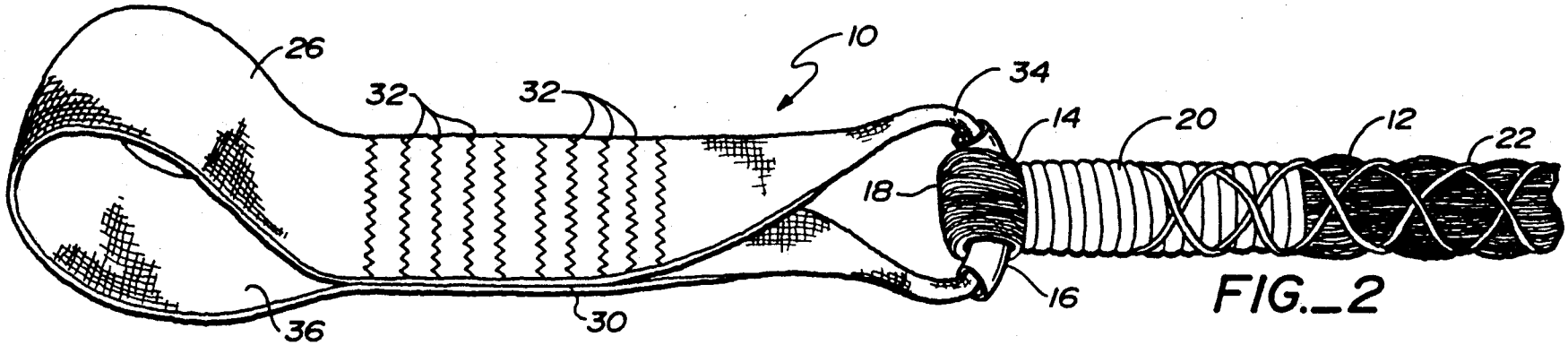
FIG. 2 is an enlarged view of an end of the elastic cord incorporated in the apparatus shown in FIG. 1 combined with an attachment element.
Figure 3:
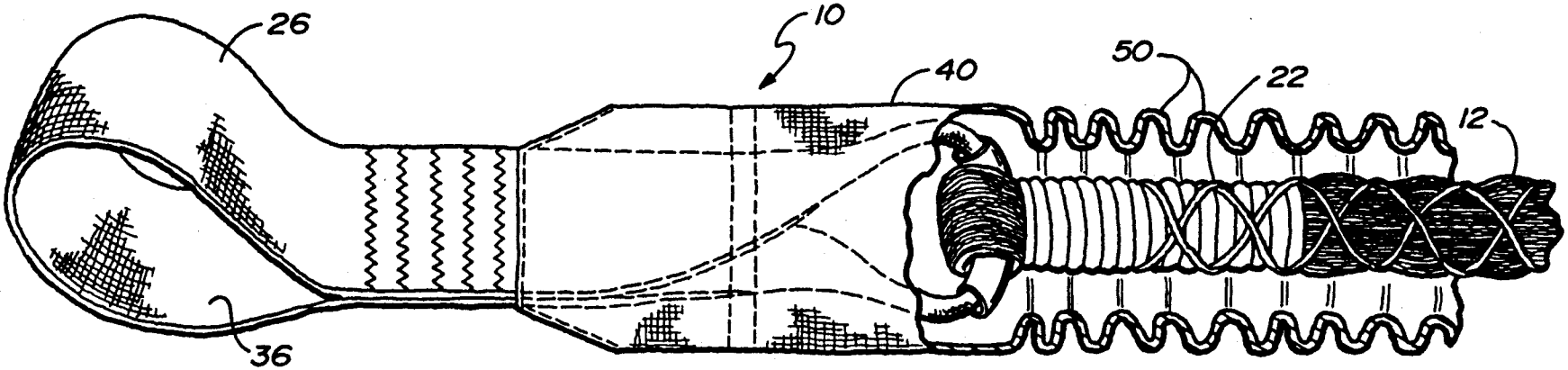
FIG. 3 is a view similar to FIG. 2 but illustrating shroud means in combination with the elastic cord and attachment element.

Referring now to FIG. 1–3, apparatus constructed in accordance with the teachings of the present invention is designated generally by reference numeral 10 Apparatus 10 includes a multi-strand elastic cord 12 formed of rubber or the like. For illustrative purposes, cord 10 is an elastic cord of the type employed, for example, in bungee jumping.

One end of the cord is shown in FIGS. 2 and 3. It will be seen that the cord is doubled back on itself to form engaging cord segments 14, 16 defining a bight 18. Fastener means in the form of a serving 20 is disposed about the engaging cord segments for maintaining the bight. Serving 20 may, for example, be of the construction disclosed in my co-pending U.S. application Ser. No. 07/773,015, filed Oct. 8, 1991; however, servings per se are known in the prior art and the serving may be of any suitable type. Elastic strands 22 may extend about the elastic cord 12 and along the length thereof to maintain the strands of the elastic cord 12 together.

An attachment element in the form of a strap 26, which may for example be constructed of nylon webbing, is secured at one end of the elastic cord 12. In like manner, a strap 28 (FIG. 1) is attached to the other end of the cord 12 in the manner which will now be described with respect to strap 26. Strap 26 is formed from a length of strap or webbing which has been configured so that the free ends thereof meet at juncture 30. Stitching 32 is employed to maintain the strap configured as illustrated. A portion 34 of the strap is rolled or folded about itself so that it passes through the restricted opening defined by bight 18. In the arrangement shown, a length of flexible conduit is disposed about strap portion 3 and located between the bight and strap portion. Such an arrangement reduces friction between strap portion 34 and the bight of the elastic cord and reduces wear and tear which would otherwise be occasioned thereby. Strap 26 forms a loop 36 remote from bight 18 employed to connect the strap to any desired object. For example loop 36 may be connected to the body harness of a bungee jumper or to an elevated object supporting the apparatus.

Apparatus 10 also includes a tubular-shaped shroud 40 which extends along the full length of elastic cord 12. At its ends shroud 40 is stitched to straps 26, 28 by stitching 42. The stitching 42 may, for example, include a box X tack 44 and lines of bar tacks 46. In any event, the stitching must be of sufficient character to prevent the shroud 40 from being ripped or torn away from the straps. Also, of course, the stitching should present a neat appearance for aesthetic reasons. The stitching should completely close off the ends of the shroud 40 so that dirt or other foreign matter cannot enter same.

When the elastic cord is in its unstretched condition, i.e. the condition shown in FIGS. 1-3, the shroud has many pleats 50 formed along the length thereof. This means that the elastic cord 12 may stretch a predetermined distance without the shroud exerting any restraining movement thereon. When, however, the shroud is sufficiently stretched so that all of the pleats 50 are straightened, the shroud acts immediately upon such straightening to halt any further stretching of the elastic cord. This action is a result of the fact that the shroud is formed of a woven fabric such as woven nylon. Such material has no appreciable or substantial "give" or stretch. This is to be compared with a braided material which by its very nature is capable of significant stretch.

The present apparatus therefore provides a means for assuring that a bungee jumper (or for that matter any object) can only cause elongation of the elastic cord up to a predetermined distance. For example, the shroud length may be chosen to allow a 400 per cent stretch of the bungee cord simply by fabricating the shroud from a length of tubular-shaped shroud material four times the length of the unstretched elastic cord. At the same time, the shroud will provide continuous protection for the elastic cord by preventing wear and tear on the cord due to abrasion, foreign material contacting the cord, ultraviolet light, etc.

Figure 4:
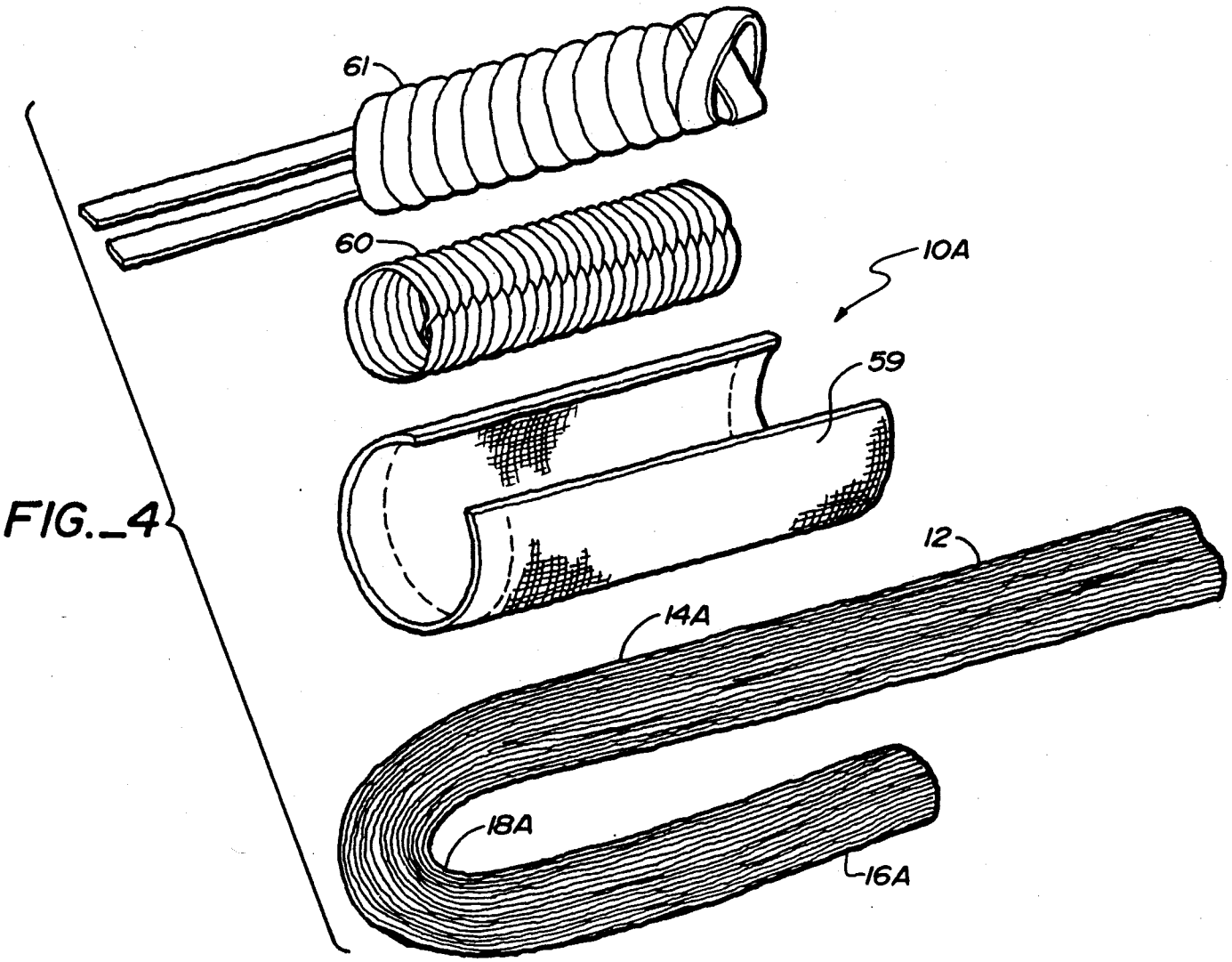
FIG. 4 is an exploded perspective view of components of an alternative embodiment of the apparatus.
Figure 5:
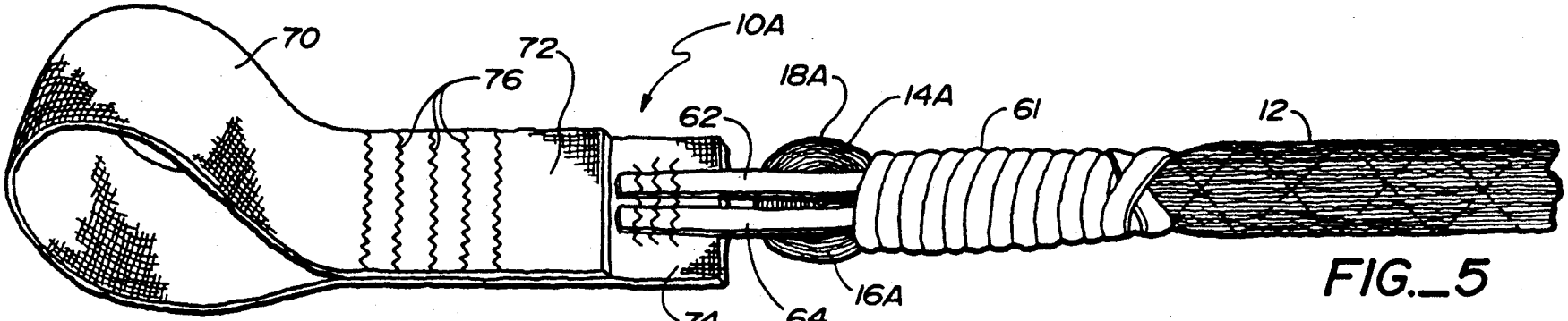
FIG. 5 is a view similar to FIG. 2 but illustrating the alternative embodiment of the apparatus.
Figure 6:
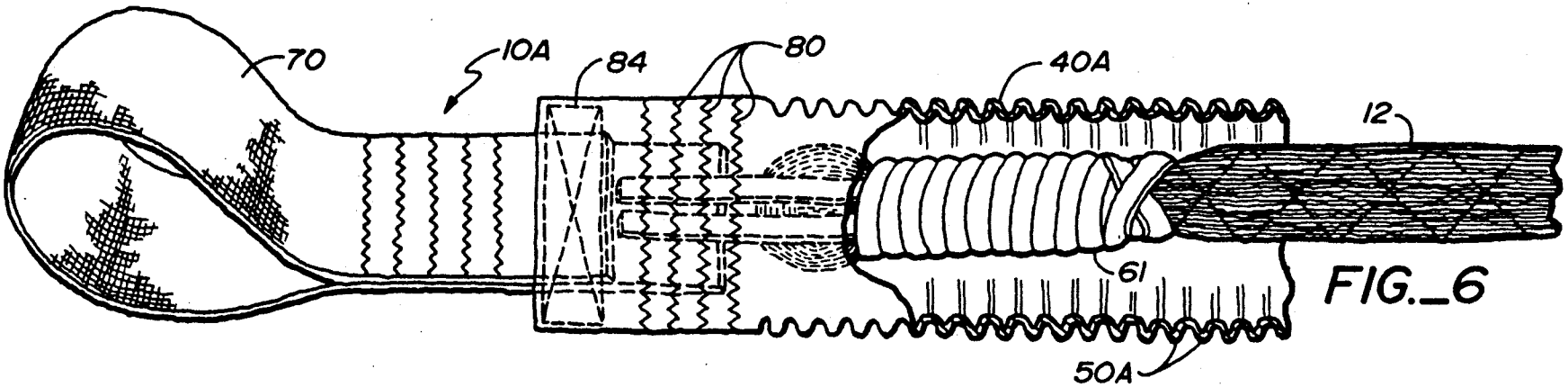
FIG. 6 is a view similar to FIG. 3 but illustrating the alternative form of the apparatus.

FIGS. 4, 5 and 6 illustrate an alternative form 10A of the apparatus. In this embodiment multi-strand elastic cord 12 has cord segments 14A, 16A folded over upon themselves to provide a bight 18A. A liner 59 of cotton fabric or the like is wrapped about cord 12. Next, cord segments 14A, 16A are fastened together by an inner binding or serving 60. The inner binding is then covered by binding or cinch belt 61 which has free ends 62, 64 extending beyond the bight 18A. The binding belt 61, which may be formed of nylon webbing or the like, is knotted or cinched as shown so that the belt tightly constricts the cord segments at two spaced locations. Pulling of the belt ends 62, 64 serves to tighten the cinching.

Apparatus 10A includes a strap 70 of nylon webbing or the like having strap ends 72, 74 engaged in partial registry and maintained in such position by stitching 76. Belt ends 62, 64 are positioned in engagement with strap end 74 and a shroud 40A having pleats 50A is located thereover and secured to both strap end 74 and belt ends 62, 64 by line stitching 80. Box X tacking 84, bar tacking, or stitching may be utilized to secure the shroud end to both strap ends 72, 74, as shown. It will be appreciated that with this construction also, the stretch of the elastic cord is positively limited by the shroud.

I claim:

1. In combination:

an elastic cord having spaced ends;

an attachment element at each of said elastic cord ends for attaching said elastic cord ends to relatively moveable objects, movement of said objects away from each other stretching said elastic cord;

shroud means wholly covering said elastic cord, extending between said attachment elements, and affixed to said attachment elements, said shroud means comprising flexible generally tubular-shaped member extending along the full length of said elastic rod and forming a plurality of pleats when said elastic cord is in the elongated condition, said generally tubular-shaped member being formed of woven fabric material which becomes unpleated when said objects are moved away from each other a predetermined distance, and said generally tubular-shaped member operable upon unpleating thereof to positively prevent said objects from moving substantially further apart than said predetermined distance, said generally tubular-shaped member being unaffixed to the elastic cord along the full length of said elastic cord whereby stretching of said elastic cord will not be impeded by said generally tubular-shaped member until the objects have moved said predetermined distance, at least one of said attachment elements comprising a strap affixed to an end of said elastic cord and forming a loop projecting from said elastic cord end and having overlapping strap portions, said generally tubular-shaped member partially covering said strap and affixed thereto by stitching passing through both said overlapping portions of said strap and through said generally tubular-shaped member on opposed sides of said strap to close the end of said as generally tubular-shaped member, said stitching big spaced outwardly away from the end of said elastic cord to which said strap is affixed, said elastic cord being doubled back on itself to form engaging cord segments defining a bight at each said elastic cord end and additionally comprising fastener means disposed about said engaging cord segments for maintaining said bight, said attachment elements being connected t said bights.

2. The combination according to claim 1 wherein said generally tubular-shaped member is formed of woven nylon.

3. The combination according to claim 1 wherein said bight defines an opening and wherein said strap passes through said bight opening to interconnect said elastic cord and said strap, said bight being covered by said tubular-shaped member, and said tubular-shaped member being affixed to the strap passing through said bight opening at a location spaced from said bight.

4. The combination according to claim 1 wherein said fastener means comprises a serving tightly binding said cord segments immediately adjacent to said bight.

5. The combination according to claim 1 wherein said fastener means comprises a binding belt tightly binding said cord segments, said binding belt having belt ends extending beyond said bight and attached to said strap.

6. The combination according to claim 5 wherein said strap has two ends in at least partial registry, said binding belt ends being affixed to at least one of said strap ends.

7. The combination according to claim 6 wherein said binding belt ends, said strap ends, and said shroud are stitched together.

* * * * *